US008065804B1

(12) United States Patent
Douzanis

(10) Patent No.: US 8,065,804 B1
(45) Date of Patent: Nov. 29, 2011

(54) KNIFE OPENING ASSIST

(76) Inventor: Ronald E. Douzanis, Lakeville, MA (US)

( * ) Notice: Subject to any disclaimer, the term of this patent is extended or adjusted under 35 U.S.C. 154(b) by 482 days.

(21) Appl. No.: 11/818,626

(22) Filed: Jun. 15, 2007

Related U.S. Application Data

(63) Continuation-in-part of application No. 11/100,030, filed on Apr. 5, 2005, now abandoned.

(51) Int. Cl.
*B26B 1/08* (2006.01)
*B26B 29/02* (2006.01)

(52) U.S. Cl. ..... 30/161; 30/158; 30/160; 30/162

(58) Field of Classification Search ..... 30/161, 30/160, 158, 155, 164, 295, 153, 152, 154, 30/156, 157, 159, 162, 163; D8/105, 99, D8/14, 55, 21, 22, 23, 83, 87, 93, 94
See application file for complete search history.

(56) References Cited

U.S. PATENT DOCUMENTS

| | | | | |
|---|---|---|---|---|
| 108,141 | A | 10/1870 | Houseman et al. | |
| 303,855 | A * | 8/1884 | Hunt | 30/155 |
| 369,314 | A | 9/1887 | Brougher | |
| 431,584 | A | 7/1890 | Holland | |
| 552,077 | A | 12/1895 | Wagner | |
| 847,474 | A | 3/1907 | Hawley | |
| 947,980 | A | 2/1910 | Romano | |
| 1,750,577 | A | 3/1930 | Bracht | |
| 2,793,891 | A * | 5/1957 | Frye | 292/18 |
| D228,545 | S | 10/1973 | Beddick | |
| 4,095,337 | A | 6/1978 | Pharr | |
| 5,009,008 | A | 4/1991 | Yablonovitch | |
| D333,859 | S | 3/1993 | Meyer | |
| 5,511,311 | A * | 4/1996 | Collins | 30/162 |
| D379,294 | S | 5/1997 | Lum | |
| D382,459 | S | 8/1997 | Khalsa | |
| 5,769,094 | A * | 6/1998 | Jenkins et al. | 30/161 |
| D397,282 | S * | 8/1998 | Derkatz | D8/107 |
| D405,338 | S * | 2/1999 | Balolia | D8/99 |
| 5,878,500 | A | 3/1999 | Emerson | |
| D422,871 | S | 4/2000 | Terzuola | |
| D425,391 | S | 5/2000 | Bradichansky | |
| D441,827 | S | 5/2001 | Frank | |
| D461,387 | S | 8/2002 | Glesser | |
| D461,681 | S | 8/2002 | Lothe | |
| 6,553,672 | B2 | 4/2003 | Glesser et al. | |
| 6,725,545 | B2 | 4/2004 | Frank | |
| D493,087 | S | 7/2004 | Wong | |
| 7,036,229 | B1 | 5/2006 | Demko | |
| 7,380,341 | B2 * | 6/2008 | Ping | 30/161 |
| 2002/0066187 | A1 | 6/2002 | Jennings | |
| 2002/0104220 | A1 | 8/2002 | Marfione | |
| 2003/0009886 | A1 | 1/2003 | Onion | |
| 2004/0020058 | A1 | 2/2004 | Vallotton | |
| 2004/0045171 | A1 | 3/2004 | Moizis | |
| 2006/0064877 | A1 * | 3/2006 | Vallotton et al. | 30/153 |

* cited by examiner

*Primary Examiner* — Ghassem Alie
(74) *Attorney, Agent, or Firm* — Milstein Zhang & Wu LLC; Joseph B. Milstein

(57) ABSTRACT

A knife opening assist removably attached to a folding knife blade. The assist is comprised of an attachment element with a channel formed therein for positioning over a portion of any blade edge opposite to the sharp blade edge. The element is attached to the blade by attachment means through apertures formed in the attachment element sides. The top of the attachment element has a hook-shaped element hooking toward the forward end of the blade. The hook is adapted to snag a pocket, holster or other container as the pocket knife is being drawn out for use.

3 Claims, 10 Drawing Sheets

KNIFE OPENING ASSIST

CROSS-REFERENCE TO RELATED APPLICATIONS

This application is a continuation-in-part of U.S. patent application Ser. No. 11/100,030, filed Apr. 5, 2005, now abandoned and claims the priority and the benefit of that application, which application is incorporated herein by reference in its entirety.

BACKGROUND OF THE INVENTION

This invention relates to the field of folding pocket knives, and in particular, to a device removably attached to the knife blade for assisting in opening the blade when the knife is withdrawn from a holster or pocket.

Handheld folding knives have been used for many years for self defense, especially by police and military personnel for self protection and to thwart an attack by an assailant. The folded knife is particularly advantageous for self defense because it occupies a small amount of space in one's pocket and also is totally safe to handle when in folded condition as the blade is securely stored in the handle.

Opening a conventional folded knife is slow and requires two hands, one holding the knife and the other engaging the blade during opening. Slowness in opening a conventional pocket knife can be a significant hindrance in a stressful situation. Stress increases the difficulty of performing ordinary motor skills. Advanced motor skills often require extensive and dedicated training. When an individual is confronted with a situation that demands stress management and the execution of advanced motor skills, a successful outcome becomes a problem.

Using a folded knife as a weapon requires withdrawing the knife from a contained position on the user's body. Rapidly drawing the weapon from the contained position requires skill. Even with skilled training, drawing a weapon without distraction and under stress is difficult to perform consistently. Drawing a weapon while managing a physical attack is significantly stressful and severely complicates the drawing process. This in turn increases the risk of injury or death. In practice, the weapon draw is measured not in seconds, but in fractions of a second. Therefore, facilitating the weapon draw will increase survivability. A means for enabling the simultaneous drawing and opening of a folded knife during a weapon's draw will provide a one-step weapon's draw and will significantly quicken a weapon draw.

Thus, there is a need for providing a means for modifying a conventional folding knife so that the folding knife will automatically and speedily open during removal of the knife from a holster or pocket; that requires only one hand to open; and that does not require any manipulation of the knife during removal other than the simple withdrawal of the knife from a holster, pocket or similar container.

The basic concept behind a folding knife is that it can be stored in a pocket or container. When the knife is withdrawn, it is then opened for use. Historically, a folding knife blade is opened from the knife handle. Opening a folding knife has evolved from a two-handed operation to a single-handed operation.

There are several ways to open a folding knife with one hand. The most common single-hand technique is to use the thumb to engage some geometry that is designed to increase the thumb's leverage on the blade. These geometries come in many shapes and sizes. Some geometries are formed out of the blade itself while others are attachments which are fastened to the blade in various ways. It is not uncommon to provide a means for applying additional pressure with a finger or thumb directly to the blade, the means preventing injury to the user from the blade.

Another single-handed opening technique is the wrist flick method. This method is facilitated by loosening the blade tension so that a quick flick of the wrist swings the blade into an open position.

Yet another method for single-handed opening of the folding knife is the classic switch blade. By depressing a release button on the folding knife, a retaining latch is opened from the spring-loaded blade causing the blade to spring open.

The opening method of interest with the present invention is a snagging technique. This method is based upon a geometry designed to snag a container, such as a pocket or holster, while the folded knife is being drawn out. The geometry provided automatically leverages the blade open as it is drawn. The inherent characteristic of the snagging technique is speed of opening. The prior art discloses snagging geometries formed as part of the blade itself. Applicant has provided examples in his Information Disclosure. However, nothing in the prior art provides geometries in the form of a removable attachment specifically adapted for opening a blade by snagging a pocket or container while the knife is being draw.

The purpose of the present invention is to permit a folding knife to be drawn as quickly as a fixed blade knife. By attaching the present invention to a folding knife, this objective is attained.

SUMMARY OF THE INVENTION

The present invention provides a knife opening assist which is removably attached to any existing folding knife blade. The assist is comprised of an attachment element with a channel formed therein for positioning over a portion of any blade edge opposite to sharp blade edge. The element is attached to the blade by an attachment means in said element. The top of the attachment element has a hook-shaped element hooking toward the forward end of the blade, said hook adapted to snag a pocket, holster or other container as the pocket knife is being drawn out for use.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 143 is a cross sectional view of the assist shown in FIG. 14A.

DETAILED DESCRIPTION OF INVENTION

Figure 1:
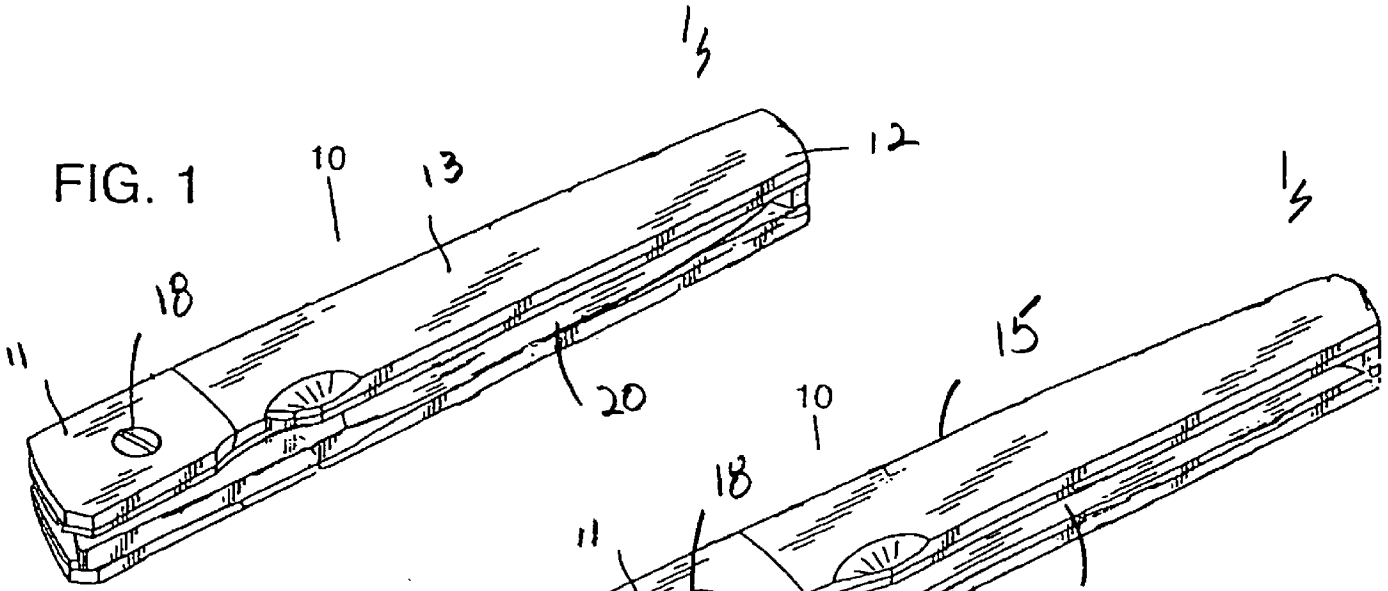
FIG. 1 is a side perspective view of a folding knife in a closed position.
Figure 2:
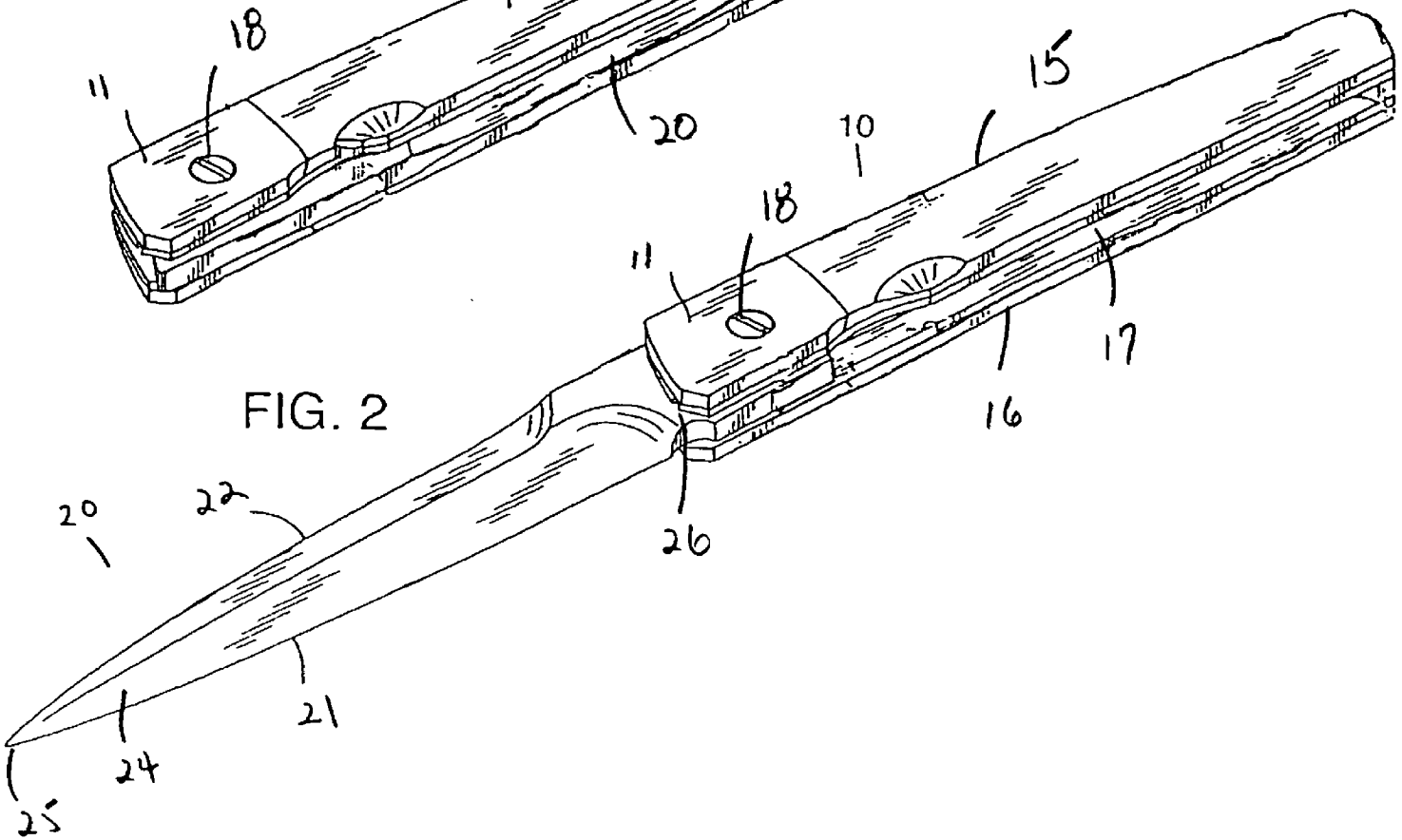
FIG. 2 is a side perspective view of the knife of FIG. 1 in an open position.
Figure 3:
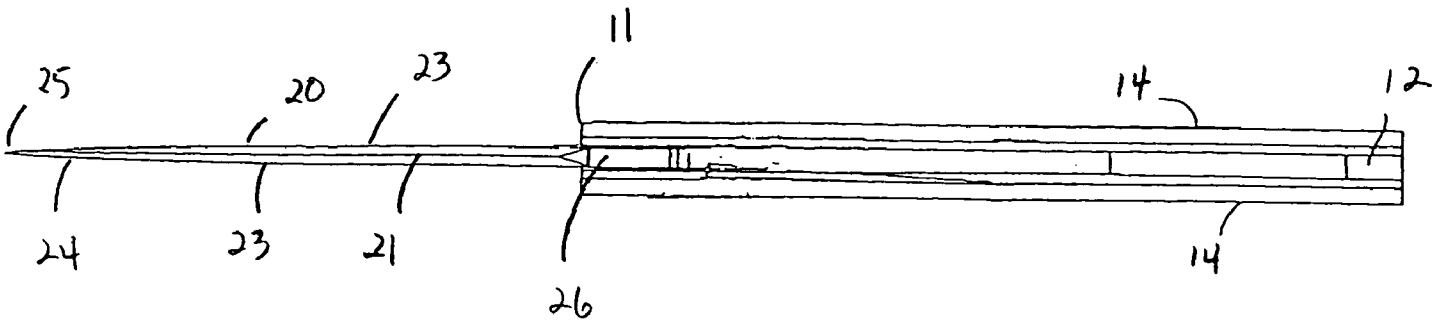
FIG. 3 is a bottom view of the knife of FIG. 2.
Figure 7:
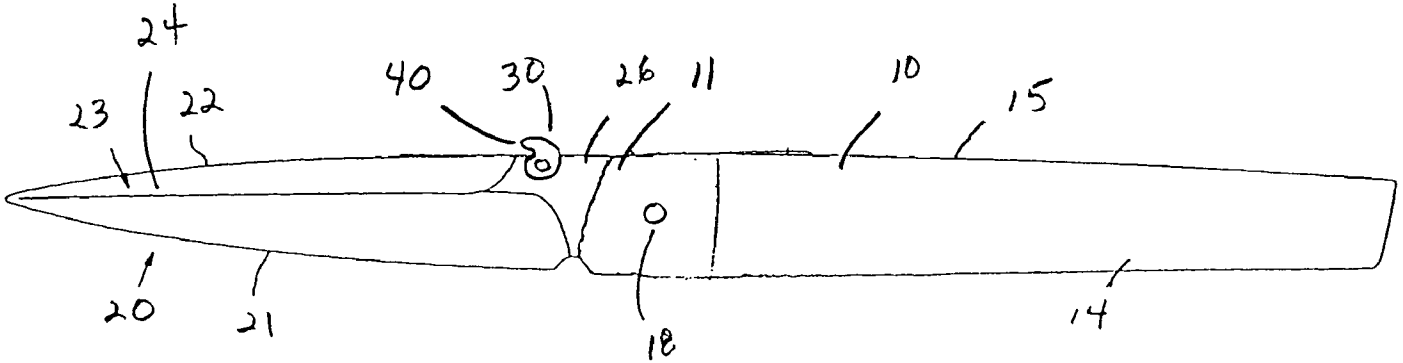
FIG. 7 is a side view of the knife of FIG. 2 with a knife opening assist.

Referring to the drawings in detail wherein like elements are indicated by like numerals, there is shown in FIGS. 1-3 a typical folding knife 1 comprised of a handle 10 and a blade 20 pivotally connected to said handle 10. The handle 10 has a forward end 11, a rear end 12, an elongated body 13 interconnecting said front and rear ends, said elongated body having two opposite sides 14, a top 15 and a bottom 16, said bottom having an elongated cavity 17 extending from said forward end 11 near to said rear end 12. The handle forward end 11 and rear end 12 define a handle longitudinal axis.

The blade 20 has a primary cutting edge 21, a secondary edge 22, two opposite, generally flat sides 23, a forward end portion 24 terminating in a tip 25, and a rear end portion 26, said forward end and rear end portions defining a blade longitudinal axis. The blade rear end portion 26 has a first aperture 27 formed therein. The blade 20 is rotatably interconnected to the forward end 11 of the handle by means of a pin 18 through the handle sides 14 near to the handle forward end 11, said pin 18 engaging the blade rear portion first aperture 27.

The knife 1 has an open position, wherein the blade 20 is in a first extended position of use and having its longitudinal axis positioned substantially co-extensive with the handle longitudinal axis. The knife 1 has a closed position wherein the blade 20 is pivoted rearward about the pin 18 with the blade cutting edge 21 substantially inserted into said handle elongated cavity 17, said blade longitudinal axis and handle longitudinal axis having a substantially parallel relationship.

Figure 4:
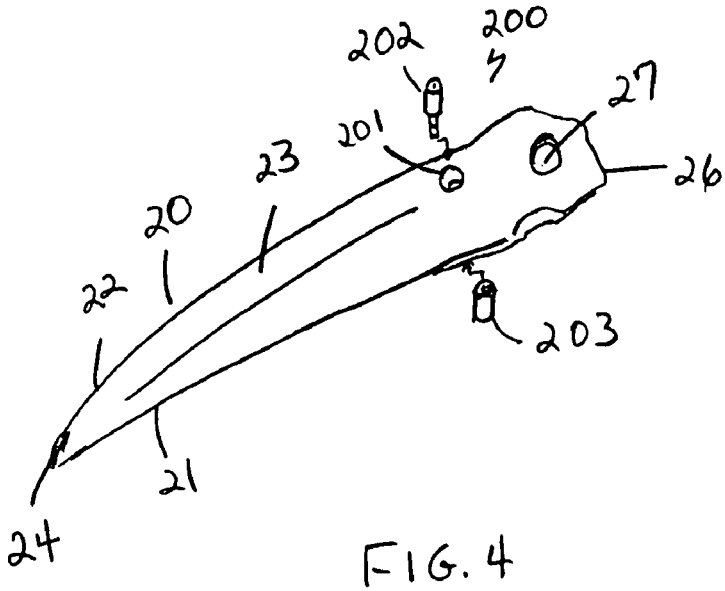
FIG. 4 is a side perspective view of a studded blade.

In various embodiments of folding knives, the knife blade 20 may be modified near to its rear end portion 26. FIG. 2 illustrates a plain knife blade 20. FIG. 4 illustrates a knife blade 20 with a stud assembly 200 attached to said blade 20 near to the blade rear end portion 26. The stud assembly 200 is attached to the blade 20 through a smooth second aperture 201 formed through the blade sides 23. The stud assembly 200 may be comprised of a stud bolt 202 threadingly engaged through the smooth second aperture 201 with a stud nut 203. As may be seen in FIG. 5 some blades will have a second aperture 205 formed near to the blade rear end portion 26. As may be seen in FIG. 6, other blade sides may have an elongated groove 207 running longitudinally adjacent to the secondary edge 22. The assist 30 of the present invention is designed to work with knife blades which are smooth, which have studs 200, which have a second aperture 205, which have elongated side grooves 207, or any combination of the above.

Figure 9:
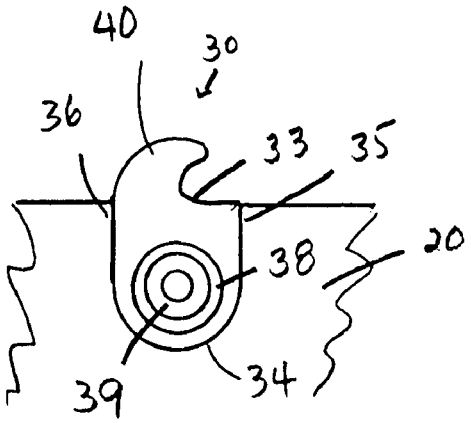
FIG. 9 is a side view of a knife opening assist mounted on a blade.
Figure 10:
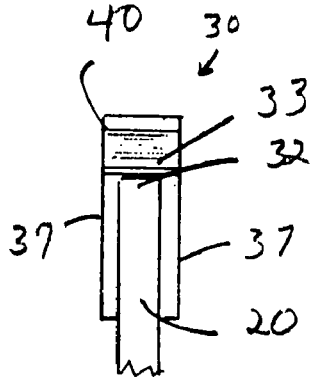
FIG. 10 is a front view thereof.
Figure 11:
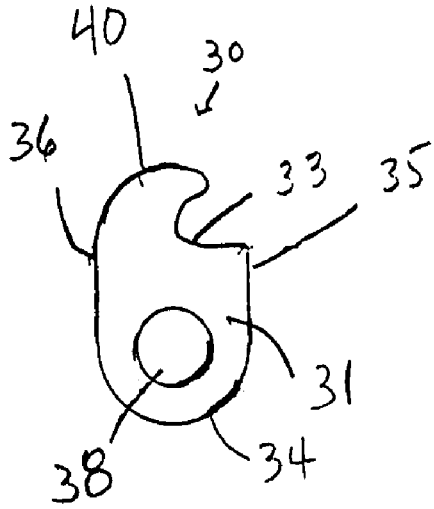
FIG. 11 is an elevational side view of a knife opening assist.
Figure 13:
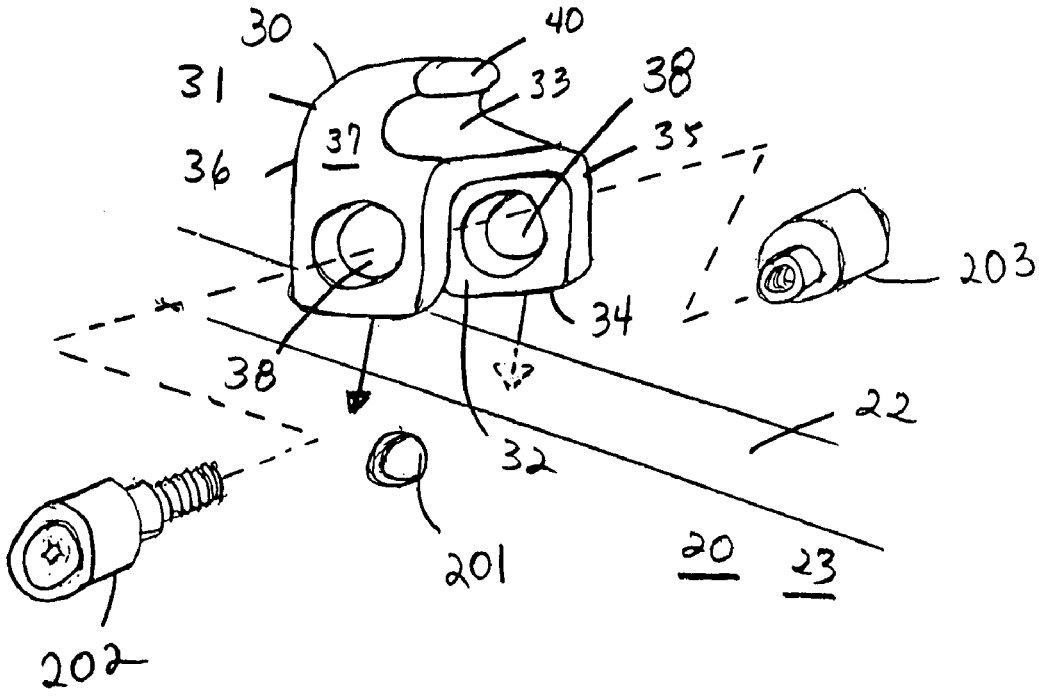
FIG. 13 is a side perspective view of the invention with a smooth aperture.
Figure 12:
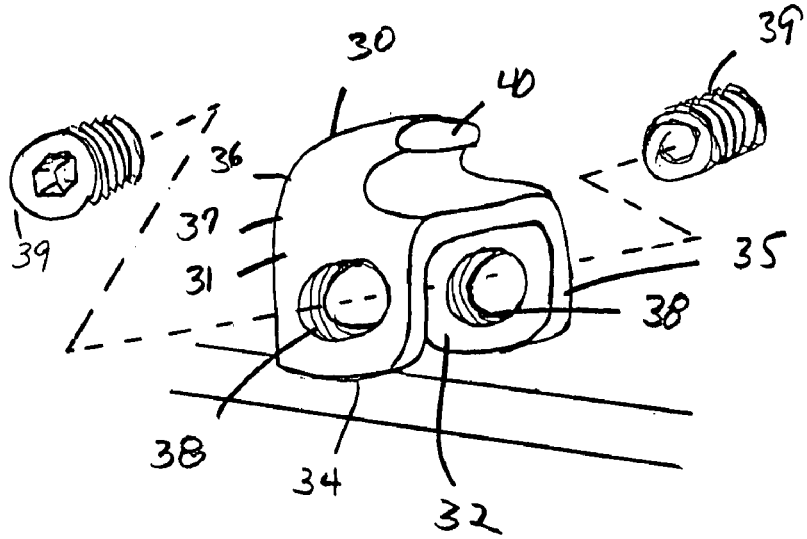
FIG. 12 is a side perspective view of the invention with a threaded aperture.
Figure 16A:
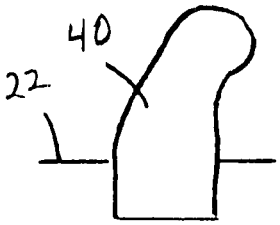
FIGS. 16A-16C are side views of assists with varying hook profiles.
Figure 16B:
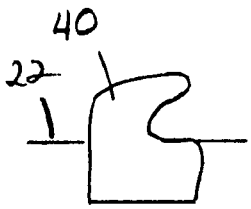
Figure 16C:
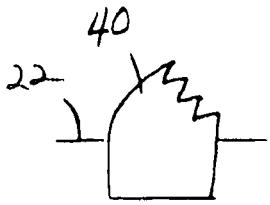

Referring to the remaining drawings, the knife opening assist 30 is removably attached to the knife blade 20. The assist 30 is comprised of an attachment element 31 with a channel 32 formed therein for positioning over a portion of the blade secondary edge 22. The attachment element 31 has a top 33, a bottom 34, a front end 35, a rear end 36, and two opposite sides 37. The channel 32 is formed in the element bottom 34 extending from front end 35 to rear end 36, said front end and rear end defining a channel longitudinal axis. Each side 37 has an aperture 38 formed therein, each said aperture 38 opening into said channel 32. The aperture 38 may be threaded as shown in FIG. 12 or smooth as shown in FIG. 13. The attachment element top 33 is formed into the shape of an upwardly and forwardly projecting hook 40, said hook projecting in the direction of the attachment element front end 35. The hook may have various shapes, e.g., height, length, contour, for specific uses. FIG. 9 illustrates a hook 40 with a classic shape. FIGS. 16A-16C illustrate hooks 40 with other contour variations. The hook 40 is adapted to snag a pocket, holster or other container as the folding knife 1 is being drawn out for use, thereby pivotally pulling the blade 20 out of the cavity 17.

Figure 17:
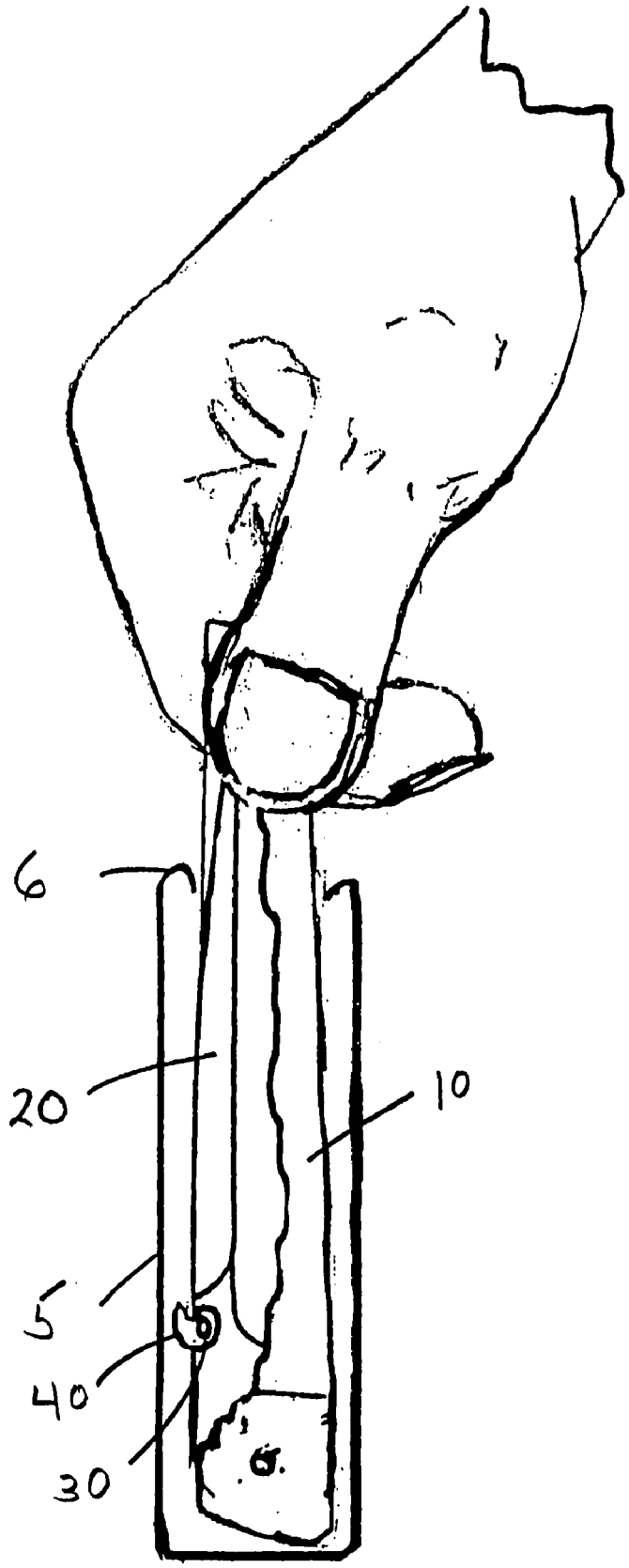
FIG. 17 is a cutaway side view of a knife and container according to one embodiment of the invention.
Figure 18A:
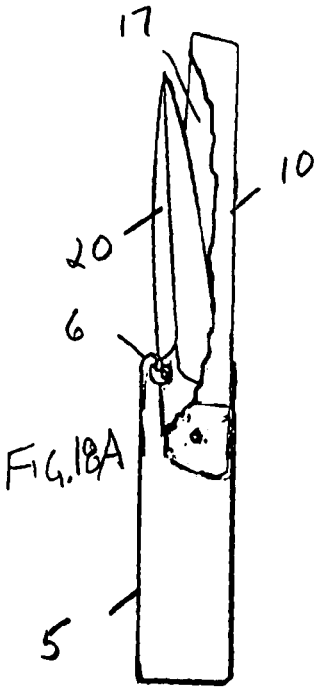
FIGS. 18A-18E are cutaway side views of a knife and container in various stages of withdrawal according to one embodiment of the invention.
Figure 18B:
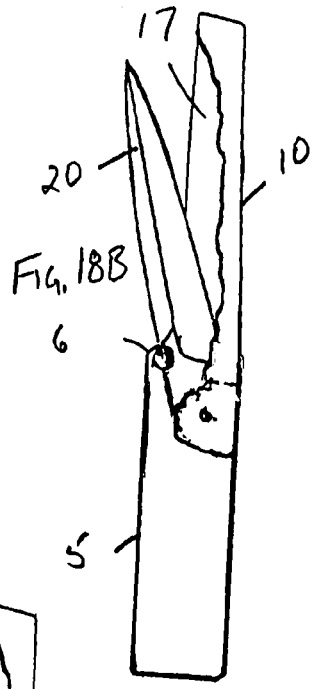
Figure 18C:
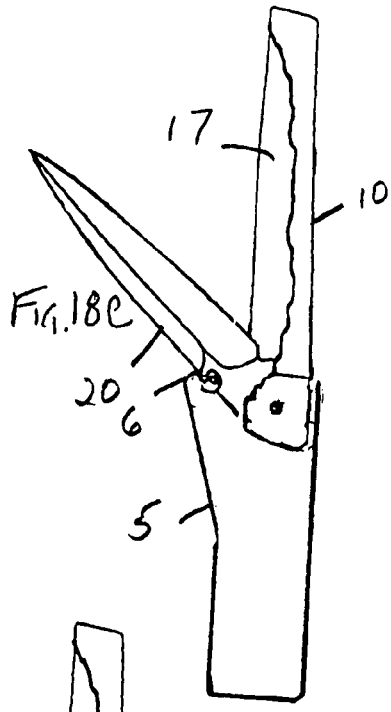
Figure 18D:
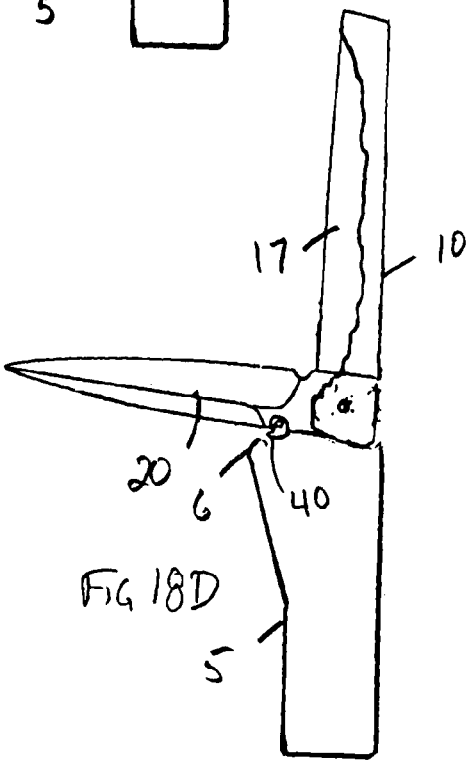
Figure 18E:
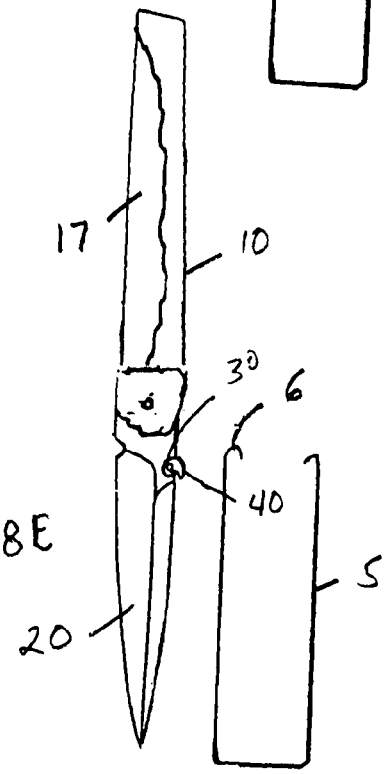

FIG. 17 shows an exemplary knife 1 being withdrawn from a container 5. FIGS. 18A-18E show an exemplary folding knife 1 with a hook 40 in various stages of withdrawal from a container 5. As shown the hook 5 is adapted to snag a container lip 6 or edge as the folding knife 1 is being drawn out for use, thereby pivotally pulling the blade 20 out of a cavity 17 in the knife handle 10. The container 5 may be a clothing pocket or a holster.

Figure 5:
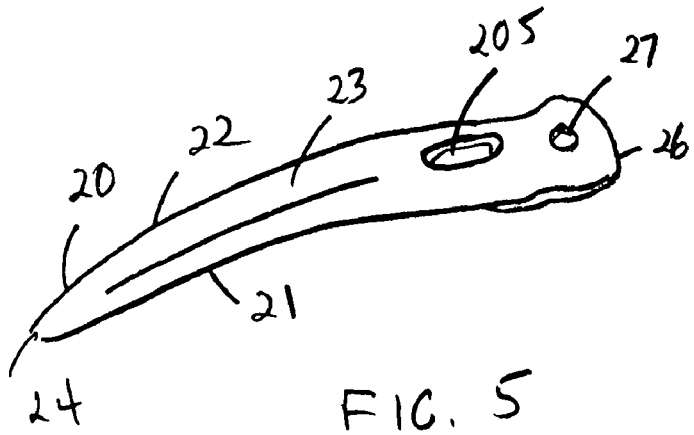
FIG. 5 is a side perspective view of a blade with a larger aperture.
Figure 6:
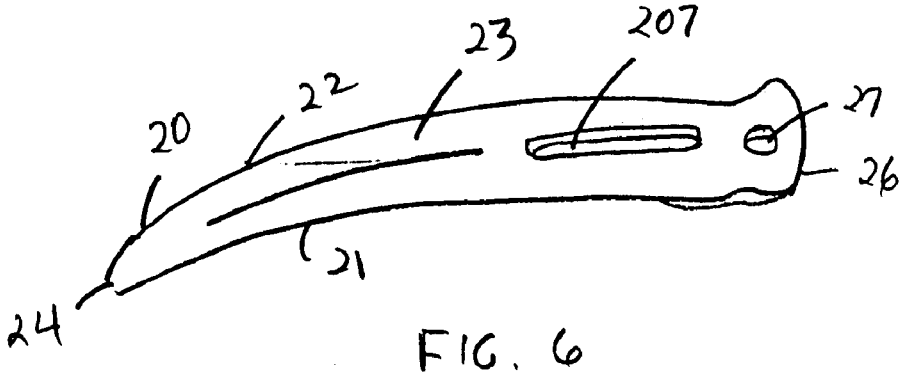
FIG. 6 is a side perspective view of a slotted blade.
Figure 8:
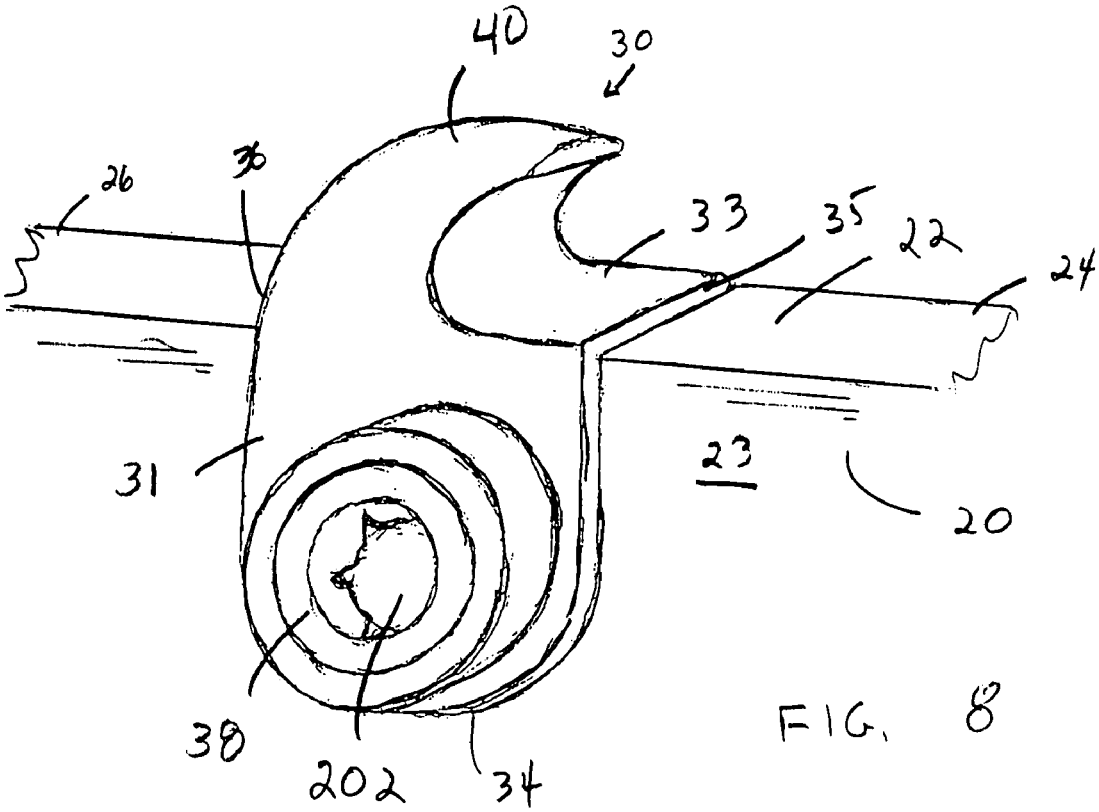
FIG. 8 is a side perspective view of the knife opening assist mounted on a blade.
Figure 14E:
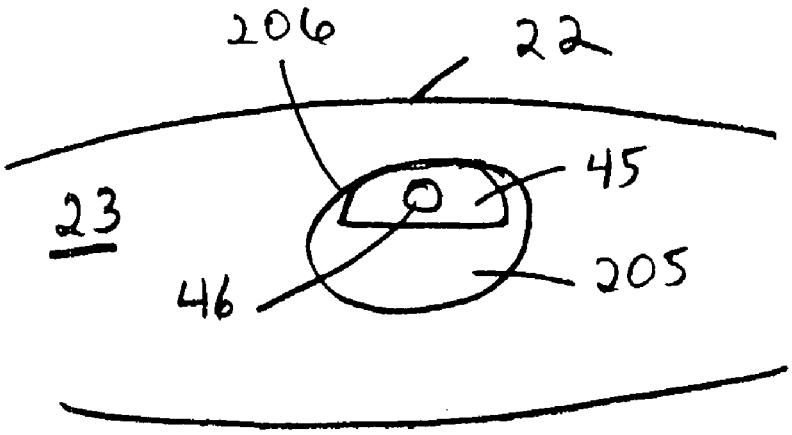
FIG. 14E is a side view of the insert positioned in a blade aperture.
Figure 14A:
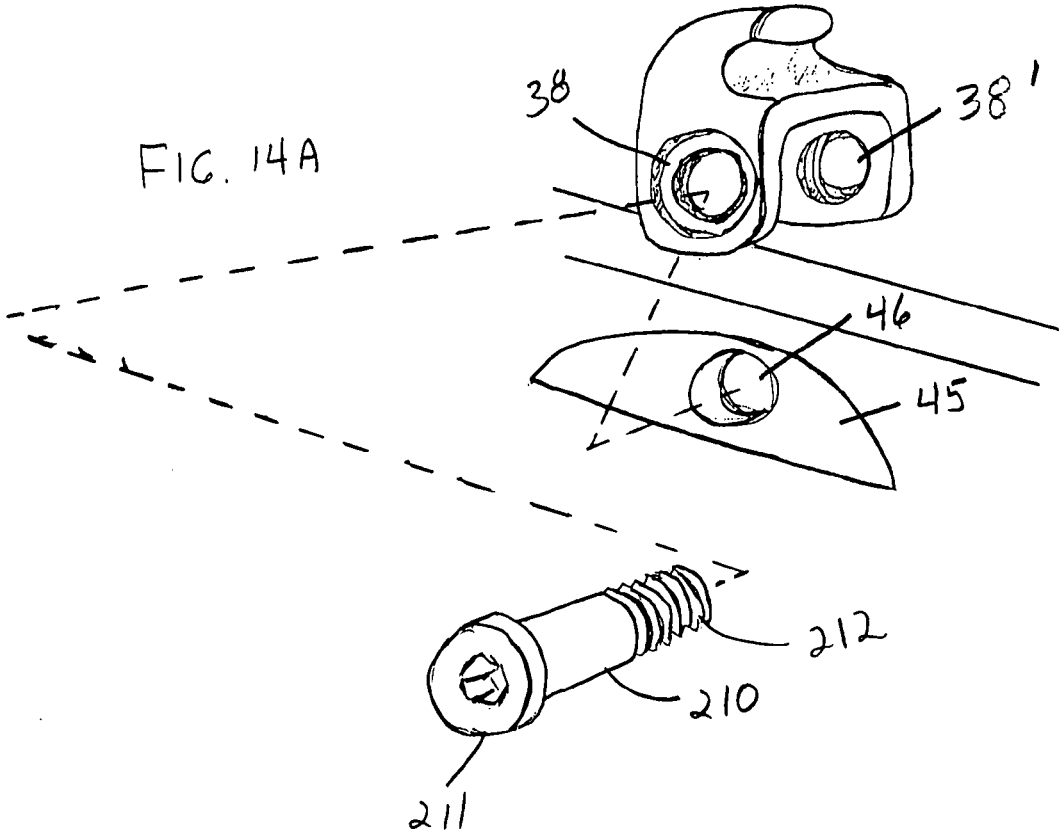
FIG. 14A is a side view of another embodiment of the invention.
Figure 14B:
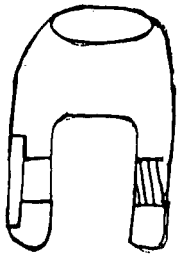
FIG. 14C is a side view of the assist shown in FIG. 14A.
FIG. 14D is a side perspective view of an insert used in FIG. 14A.
Figure 14C:
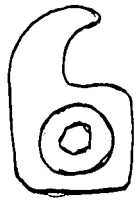

The assist 30 is further comprised of means for attaching the assist 30 to blade 20. In one embodiment of the invention, the attachment means is comprised of a threaded lockable set screw 39 threadingly engaging each threaded aperture 38. See FIGS. 9 and 12. The assist 30 is positioned onto the blade secondary edge 22, wherein the attachment element channel 32 fits over the blade secondary edge 22, said attachment element sides 37 overlapping a portion of the blade sides 23. The attachment element front end 35 faces the blade forward end portion 24 and said attachment element rear end 36 faces the blade rear end portion 26. Where the blade sides 23 are solid, the assist 30 is used with two threaded lockable set screws 39, one for each attachment element aperture 38. The screws 39 hold the assist 30 in place on the blade 20.

Where a studded knife blade 20 as shown in FIG. 4 is provided, the assist 30 of FIGS. 8 and 13 are used, said assist having smooth bore apertures 38 adapted for use in conjunction with the stud assembly 200. The assist apertures 38 are aligned with the blade second aperture 201. The stud bolt 202 and stud nut 203 are threadingly joined through the smooth assist apertures 38 and blade second aperture 201. See FIG. 13.

Where there is a blade second aperture 201 or 205, such as shown in FIGS. 4 and 5, one long lockable bolt or set screw 210 may be used, said bolt 210 extending from one element aperture 38, through the blade second aperture 201 or 205, and into the opposite element aperture 38. The assist apertures 38 may be designed so that one aperture 38 is smooth and countersunk for accommodating the bolt head 211. The opposite aperture 38' may be threaded to threadingly engage the bolt threads 212. See FIGS. 14A-C.

Figure 14D:
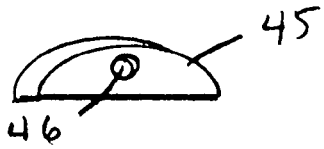

In another embodiment of the invention, an assist insert 45 having the general circumferential shape of the blade second aperture 205 may be used. See FIGS. 14D and 14E. The insert 45 has an aperture 46 having a central axis concentric with the assist apertures 38, 38'. The insert aperture 46 accommodates a threaded lockable long bolt or set screw 210 which goes through smooth apertures 38 and 46 and engages the opposite assist threaded aperture 38'. See FIG. 14A.

Figure 15A:
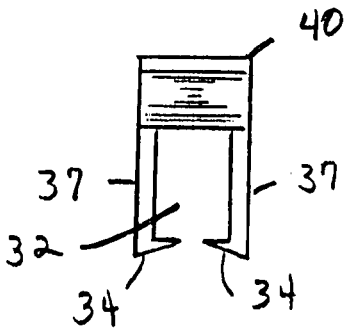
FIG. 15A is a front view of an assist with bottom clip.
Figure 15B:
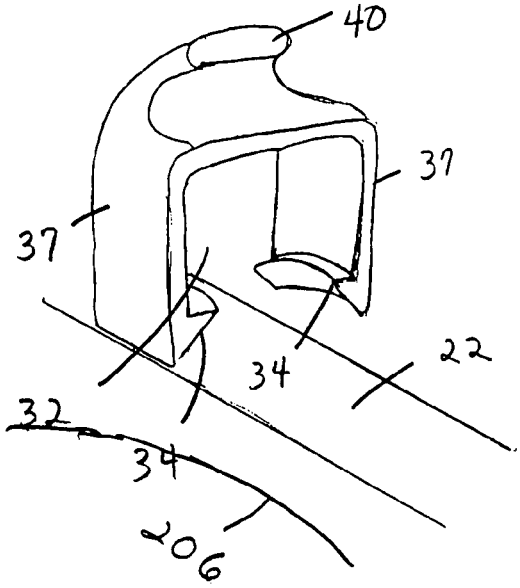
FIG. 15B is a front perspective view of an assist with a bottom clip.

In still another embodiment, the assist bottom 34 may be formed into a clip shape adapted to grasp a blade second aperture upper edge 206. See FIGS. 15A and 15B.

The present invention adds a knife opening assist 30 enabling the simultaneous drawing and opening of a folded knife during a weapon's draw, resulting in a one-step weapon draw. The assist attachment hook-shaped element 40, oriented toward the forward end of the blade, is adapted to snag a pocket, holster or other container as the folding knife is being drawn out for use. The assist 30 thereby draws the blade 20 out of the handle cavity 17 as the knife is being drawn from its container, i.e., pocket or holster.

It is understood that the above-described embodiment is merely illustrative of the application. Other embodiments may be readily devised by those skilled in the art which will embody the principles of the invention and fall within the spirit and scope thereof.

I claim:

1. A knife opening assist for use in conjunction with a pre-existing folding knife having a blade with a sharp edge and a sharp tip, the folding knife having the blade foldably attached to a knife handle, the knife opening assist for use in conjunction with a pre-existing container for containing the folding knife in a folded condition, the knife opening assist comprising:

an alignment portion having a channel formed therein, said channel configured to position said alignment portion over a portion of said blade opposite to the sharp blade edge of the folding knife;

an upwardly and forwardly projecting hook; and an attachment element connected to said alignment portion and configured to removably attach said alignment portion and said hook to the portion of the blade opposite to the sharp blade edge of the folding knife, said hook projecting in the direction of a front end of said attachment element, said hook configured to face toward the sharp tip of the blade of the folding knife so as to snag said container as the folding knife is being drawn out of the container for use;

said knife opening assist configured to automatically open the folding knife during removal of the folding knife from the container, and said knife opening assist configured to not require any manipulation of the knife opening assist during removal other than the simple withdrawal of the folding knife from the container.

2. The knife opening assist of claim 1, wherein said attachment element comprises a threaded attachment element.

3. The knife opening assist of claim 1, wherein said attachment element comprises a clip attachment element.

* * * * *